US007011697B2

(12) United States Patent
Kato et al.

(10) Patent No.: US 7,011,697 B2
(45) Date of Patent: Mar. 14, 2006

(54) ELECTROLESS GOLD PLATING SOLUTION

(75) Inventors: Masaru Kato, Saitama (JP); Kazutaka Senda, Saitama (JP)

(73) Assignee: Kanto Kagaku Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/969,604

(22) Filed: Oct. 20, 2004

(65) Prior Publication Data

US 2005/0098061 A1 May 12, 2005

(30) Foreign Application Priority Data

Oct. 22, 2003 (JP) ..... 2003-362452
Sep. 3, 2004 (JP) ..... 2004-256574

(51) Int. Cl.
*C23C 18/40* (2006.01)

(52) U.S. Cl. ..... 106/1.23; 106/1.26

(58) Field of Classification Search ..... 106/1.23, 106/1.26
See application file for complete search history.

(56) References Cited

U.S. PATENT DOCUMENTS 4,481,035 A 11/1984 Andrascek et al.
5,470,381 A * 11/1995 Kato et al. ..... 106/1.23
5,614,004 A * 3/1997 Wachi et al. ..... 106/1.23
5,803,957 A * 9/1998 Murakami et al. ..... 106/1.13
6,336,962 B1 * 1/2002 Backus et al. ..... 106/1.23
6,533,849 B1 * 3/2003 Fang ..... 106/1.23
2004/0118317 A1 * 6/2004 Iwai et al. ..... 106/1.23
2005/0031895 A1 * 2/2005 Suda et al. ..... 428/672

FOREIGN PATENT DOCUMENTS

JP 59-85855 A 5/1984
JP 60-125379 A 7/1985

OTHER PUBLICATIONS

Okinaka, Y., "Electroless Gold Deposition Using Borohydride or Dimethylamine Borane as Reducing Agent," Plating, 57, 914 (1970), no month available.
Kenkyukai, Denkimekki, "Electroless Plating Basics and Application," The Nikkan Kogyo Shimbun, Ltd., 1994, 167-168, with an abridged English translation of section 7.1.4, no month.

* cited by examiner

*Primary Examiner*—Helene Klemanski
(74) *Attorney, Agent, or Firm*—Wolf, Greenfield & Sacks, P.C.

(57) ABSTRACT

An electroless gold plating solution is provided that includes a cyanide compound and ascorbic acid or a derivative thereof, the electroless gold plating solution containing one or more than one deposition accelerator selected from the group consisting of a copper compound, a thallium compound, and a lead compound.

8 Claims, No Drawings

ELECTROLESS GOLD PLATING SOLUTION

BACKGROUND OF THE INVENTION

1. Field of the Invention

The present invention relates to an autocatalytic electroless gold plating method that is capable of giving an adequate plating rate and continuous thick gold over a wide pH range from acidic to neutral conditions. In particular, it relates to an electroless plating solution that is suitable for industrial use and is capable of giving an adequate plating rate and a continuous thickness of gold by an autocatalytic electroless reaction even under acidic conditions, which are not often employed conventionally because the reducing power of a reducing agent is weakened.

2. Description of Related Art

In recent years, electronic equipment such as cellular phones has been developed so as to have a small size, multiple functions, and high performance. This is due to 'high integration and microfabrication of semiconductor chips', which is a core technology, and also to progress in 'packaging technology' for packaging the device by external connection and mounting on a substrate. Because of increases in fineness and complexity of wiring of printed wiring boards and semiconductor chips, an increase in isolated circuits, an increase in fineness and a decrease in pitch of internal and external connecting terminals, electroless gold plating has been employed instead of gold electroplating, which requires leads for carrying current. The electroless gold plating employed here is a plating method that enables the deposition of soft gold suitable for wire bonding or flip chip connection.

With regard to the autocatalytic electroless gold plating solution, in terms of the bath composition, two types have been developed and put to practical use, that is, a cyanide-based bath, and a cyanide-free bath, which employs no cyanide. The cyanide-based plating solution is currently used in a wide range of applications since it has the advantages of gold cyanide complex stability, low cost, etc. For example, a cyanide-based plating solution containing a gold cyanide salt ($KAu(CN)_2$, etc.) as a gold salt and an alkali metal tetrahydroborate ($KBH_4$, etc.) or DMAB: dimethylamine-borane ($(CH_3)_2NHBH_3$) as a reducing agent has been developed by Okinaka (Plating, 57, 914 (1970)).

A gold cyanide complex used as the gold salt in the cyanide-based bath is the most stable complex ($Au(CN)_2^-$ complex stability constant: $10^{39}$) among currently known gold complexes. In order to make gold deposit from this gold cyanide complex, it is necessary to use a strong reducing agent such as DMAB, and at the same time employ high temperature and highly alkaline operating conditions, but with regard to the physical properties of the gold thus deposited, it is high purity soft gold and suitable for wire bonding, etc. However, since the operating conditions involve high temperature, strong alkali, a large amount of highly toxic free cyanide, etc., there are the problems that they cannot be applied to a material that is susceptible to alkali, such as polyimide or aluminum nitride, and a semiconductor material equipped with a positive photoresist cannot be plated.

In order to solve such problems, some cyanide-based electroless gold plating solutions employing various reducing agents that can be operated under acidic or neutral conditions have been reported (Denkimekki Kenkyukai, Electroless Plating—Basics and Application, The Nikkan Kogyo Shimbun, Ltd., 1994, 167–168, and JP, A, 59-85855).

However, these plating solutions have the problems that they are difficult to handle under operating conditions of about 95° C., the solution lifetime is extremely short, etc. In particular, a plating solution employing ascorbic acid as the reducing agent has a slow plating deposition rate due to its low reducing power and cannot be put to practical use. Judging from the situation that no cyanide-based autocatalytic electroless gold plating bath for use under acidic to neutral conditions is currently commercially available, no autocatalytic bath that can be used in practice under acidic to neutral conditions has actually been developed.

On the other hand, as a method for increasing the plating rate, there is a known method in which ions such as Pb ions or Tl ions are contained in a plating solution (JP, A, 60-125379), but a cyanide-based autocatalytic electroless gold plating bath containing ascorbic acid as the reducing agent and Pb ions or Tl ions as a deposition accelerator in a plating solution is not currently known.

BRIEF SUMMARY OF THE INVENTION

It is therefore an object of the present invention to solve the conventional problems relating to high temperature and strongly alkaline conditions, provide a cyanide-based electroless gold plating solution that can be used with a semiconductor material equipped with a positive photoresist, etc., and to provide a practical electroless gold plating solution that enables a thick gold coating to be obtained by increasing the plating deposition rate.

As a result of an intensive investigation by the present inventors while taking into consideration the above-mentioned problems, it has been found that the above-mentioned problems relating to temperature, pH, and speed can be solved at a stroke by a cyanide-based electroless gold plating solution employing ascorbic acid or a derivative thereof as a reducing agent and containing as a deposition accelerator one or more than one compound selected from the group consisting of a copper compound, a lead compound, and a thallium compound, and a cyanide-based electroless gold plating solution that can be used with a semiconductor material equipped with a positive photoresist, etc. has thus been accomplished.

That is, the present invention relates to an electroless gold plating solution comprising a cyanide compound and ascorbic acid or a derivative thereof, the electroless gold plating solution containing one or more than one deposition accelerator selected from the group consisting of a copper compound, a thallium compound, and a lead compound.

Furthermore, the present invention relates to the electroless gold plating solution wherein it further comprises a complexing agent.

Moreover, the present invention relates to the electroless gold plating solution wherein the deposition accelerator comprises a copper compound and a thallium compound.

Furthermore, the present invention relates to the electroless gold plating solution wherein the solution has a pH of 3 to 7.5.

Moreover, the present invention relates to the electroless gold plating solution wherein the copper compound is copper potassium cyanide, copper thiocyanate, or disodium copper ethylenediaminetetraacetate tetrahydrate.

Furthermore, the present invention relates to the electroless gold plating solution wherein the complexing agent is a cyanide compound, a thiocyanate compound, or a polycarboxylic acid.

Moreover, the present invention relates to the electroless gold plating solution wherein the thallium compound is thallium sulfate or thallium nitrate.

Among various reducing agents used in cyanide-based plating solutions, since ascorbic acid and derivatives thereof have excellent stability, the present invention employs ascorbic acid as the reducing agent. In the case of a cyanide-based plating solution, when examining a possible electroless plating reaction mechanism and the plating rate, based on hybridization theory, from the reduction deposition potential of gold ($Au(CN)_2^- + e^- \rightarrow Au + 2CN^- E^0 = -0.60$ V vs SHE; Langer's Handbook of Chemistry (McGraw-Hill)) and the oxidation potential of ascorbic acid ($C_6H_8O_6 \rightarrow C_6H_6O_6 + 2H^+ + 2e^- E^0 = +0.058$ V vs SHE; Seikagaku Jiten Third Edition (Tokyo Kagaku Doujin Co., Ltd.)), it cannot be predicted at all that autocatalytic plating would proceed as a result of addition of Tl ions or Pb ions, or that the plating rate would increase, but in the present invention a practically useful plating rate can surprisingly be obtained by adding a copper compound, a lead compound, or a thallium compound to the plating solution.

Although the mechanism of acceleration of the plating rate by the deposition accelerator in the present invention is not clear, it is surmised that deposition of gold is accelerated due to the thallium compound or the lead compound shifting the deposition potential of gold in the negative direction and due to the copper compound accelerating the oxidation of ascorbic acid, which is a reducing agent.

The electroless gold plating solution of the present invention enables plating to be carried out under acidic to weakly alkaline conditions, under which a sufficient reducing power cannot conventionally be obtained, by employing ascorbic acid as the reducing agent and by further adding a deposition accelerator. It is therefore possible to apply it to a semiconductor material equipped with a positive photoresist, for which conventional products cannot be used, thereby greatly contributing to the development of packaging technology.

Furthermore, in the present invention, since ascorbic acid is used as the reducing agent and one or more than one deposition accelerator selected from the group consisting of a copper compound, a lead compound, and a thallium compound is included, plating can be carried out at a deposition rate 4 or more times the conventional rate. In this way, the present invention employing ascorbic acid as the reducing agent exhibits outstanding effects, which cannot be predicted from conventional products.

DETAILED DESCRIPTION OF THE INVENTION

The present invention is now explained specifically and in detail for easy understanding. Although $KAu(CN)_2$ is usually used as the cyanide compound, it is not particularly limited thereto. It is possible to employ, for example, AuCN and KCN, or $NaAuCl_4$ and KCN, as long as $Au(CN)_2^-$ is formed in the solution. The gold potassium cyanide is usually used at 0.5 g to 20 g/L on a gold concentration basis. It is preferably 1 g to 10 g/L. When it is in such a range, a practical plating rate can be obtained, and this is desirable since an outstanding effect can be obtained.

The ascorbic acid derivative referred to in the present invention is a salt or an ester derivative of ascorbic acid. Specific examples thereof include alkali metal salts such as sodium ascorbate and potassium ascorbate, ammonium ascorbate salts, ascorbic acid-6-sulfate, 6-deoxy-L-ascorbic acid, and D-arabo-ascorbic acid.

The preferred concentration of ascorbic acid or the derivative thereof, which is the reducing agent of the plating solution, is 0.05 to 1.5 mol/L, and more preferably 0.1 to 1.2 mol/L. When it is in such a range, plating proceeds well, and the reducing agent can be dissolved in the plating solution without precipitating.

The copper compound that is added to the plating solution as the deposition accelerator is a water-soluble copper compound supplying copper ions, and specific examples thereof include water-soluble copper compounds such as copper cyanide, copper potassium cyanide, copper sulfate, copper pyrophosphate, copper thiocyanate, disodium copper ethylenediaminetetraacetate tetrahydrate, and copper chloride. When copper ions supplied from such a water-soluble copper compound to the plating solution are precipitated as an impurity in the form of copper sulfate, copper oxide, etc., it is preferable to add a complexing agent that suppresses the precipitation of copper ions, thus stabilizing them as a copper complex in the solution. For some types of complexing agent, hydrogen cyanide gas might be generated depending on the pH of the plating solution, and it is therefore preferable to mix the water-soluble compound and the complexing agent in advance.

With regard to the copper compound of the present invention, it can be added as a copper complex salt such as $K_3Cu(CN)_4$ or Cu-EDTA, which can be present stably in the plating solution on its own, but it is also possible to form a copper complex that can be present stably in the solution by combining a complexing agent with a compound that is difficultly soluble on its own. Examples thereof include a copper cyanide complex formed by a combination of CuCN and KCN or a combination of CuSCN and KSCN or KCN, and a Cu-EDTA complex formed by a combination of $CuSO_4$ and EDTA·2Na.

With regard to the complexing agent, a compound that can form a complex with copper ions can be used; examples thereof include inorganic compounds such as cyanide compounds and thiocyanate compounds, and polycarboxylic acids, and specific examples thereof include ethylenediaminetetraacetic acid, salts of ethylenediaminetetraacetic acid such as dihydrogen disodium ethylenediaminetetraacetate dihydrate, aminocarboxylic acids such as nitrilotriacetic acid and iminodiacetic acid, oxycarboxylic acids such as citric acid and tartaric acid, succinic acid, oxalic acid, ethylenediaminetetramethylenephosphonic acid, and glycine.

The preferred concentration of the copper compound is determined so that ascorbic acid is oxidized, and it is 0.1 to 500 mg/L on a copper basis, and preferably 1 to 200 mg/L. When it is in such a range, an effect in accelerating the plating rate, and a stable plating solution can be obtained, which are preferable in terms of practical use.

Furthermore, when a combination of a copper compound and a complexing agent is employed, the preferred concentration of the complexing agent added for stabilizing the copper compound in the plating solution is determined appropriately according to the concentration of the copper compound within a range that is sufficient for formation of a complex with copper and in which the copper ions for accelerating the deposition of gold are not affected. The preferred range is 0.1 $\mu$mol/L to 1.5 $\mu$mol/L, and more preferably 0.5 $\mu$mol/L to 1.0 $\mu$mol/L. When it is in such a range, the copper complex is stably present, and the deposition rate is accelerated.

The thallium compound used as the deposition accelerator in the present invention is a water-soluble thallium compound that supplies thallium ions, and specific examples thereof include thallium sulfate, thallium nitrate, thallium chloride, and thallium carbonate.

The lead compound used as the deposition accelerator is a water-soluble lead compound that supplies lead ions, and specific examples thereof include lead chloride, lead sulfate, lead acetate, lead nitrate, and lead methanesulfonate.

The concentration of such a deposition accelerator added is preferably 0.1 to 100 mg/L, at which concentration a deposition acceleration effect can be obtained. More preferably, it is 0.5 to 20 mg/L. When it is within the preferred range, a sufficient deposition acceleration effect can be obtained and the stability of the plating solution is improved.

The copper compound, the thallium compound, or the lead compound, which are used as the deposition accelerator, may be used singly or in a combination of two or more types. In order to enhance the deposition acceleration effect, it is preferable to combine two or more types, and such a combination is the copper compound and the thallium compound.

A preferred pH range of the present plating solution is 3 to 7.5, in which range a semiconductor material equipped with a positive photoresist can be used, and the pH is preferably in the range of 3.5 to 7.5 from the viewpoint of deposition acceleration, stability, etc., and more preferably 4 to 7. When it is in such a range, a plating reaction proceeds well, and operations can be carried out safely.

The plating solution can be used at a bath temperature of 20° C. to 95° C., at which temperature the plating reaction proceeds appropriately and no precipitation occurs due to self decomposition, and it is preferable to operate at 30° C. to 85° C., and more preferably 50° C. to 80° C.

EXAMPLES

The electroless gold plating of the present invention is further explained in detail below with reference to Examples and Comparative Examples, but they should not be construed as limiting the present invention. In the Examples below, a 2 cm×2 cm, 0.1 mm thick rolled nickel or rolled copper sheet was plated by electroplating with soft gold having a purity of 99.9% or greater at 3 μm, and this was used as a plating sample. Furthermore, as pretreatments, the plating sample was subjected to degreasing of a negative electrode with a commercial alkaline electrolysis degreasing solution and washing with a 10% sulfuric acid solution, and then subjected to the plating of the Examples and Comparative Examples described below.

Example 1

Electroless plating was carried out by immersing for a predetermined period of time a test piece of the above-mentioned plating sample in a plating solution having the solution composition shown below. As a result, bright golden semi-gloss gold was deposited at a thickness of 0.15 μm when immersed for 1 hour and at 0.47 μm when immersed for 3 hours, and the gold coating thickness could be seen to increase linearly as time elapsed. As is clear from comparison with Comparative Example 1, which will be described later and to which a very small amount of copper compound was not added, the plating solution of the present invention, to which a small amount of copper compound was added, had a deposition rate about 6 times that of the plating solution to which the copper compound was not added. Furthermore, the plating solution did not show any formation of precipitate, any change in solution color, etc., and had excellent stability.

| Plating solution composition | |
|---|---|
| Gold potassium cyanide | 0.02 mol/L |
| Sodium ascorbate | 1.0 mol/L |
| Copper cyanide | 10 mg/L(as copper) |
| Potassium cyanide | 0.0005 mmol/L |
| Citric acid | appropriate amount for adjusting pH to 7.0 |

| Plating conditions | |
|---|---|
| Solution temperature | 80° C. |
| Solution pH | 7.0 |
| Stirring | stirred by stirrer |

Example 2

Electroless plating was carried out by the same method and using a test piece of the same plating sample as in Example 1, but using a plating solution with 1 mg/L of thallium ion (added as thallium sulfate) added thereto instead of the copper cyanide and the potassium cyanide of the plating solution composition used in Example 1. As a result, bright golden semi-gloss gold was deposited at a thickness of 0.15 μm when immersed for 1 hour and at 0.45 μm when immersed for 3 hours, and the gold coating thickness could be seen to increase linearly as time elapsed. As is clear from comparison with Comparative Example 1, which will be described later, the addition of the very small amount of thallium ion increased the deposition rate by about 6 times compared with the plating solution to which it was not added. Furthermore, the plating solution did not show any formation of precipitate, any change in solution color, etc., and had excellent stability.

Example 3

Electroless plating was carried out by the same method and using a test piece of the same plating sample as in Example 1, but using a plating solution obtained by adding 1 mg/L of thallium ion (added as thallium sulfate) to the plating solution composition used in Example 1. As a result, bright golden semi-gloss gold was deposited at a thickness of 0.18 μm when immersed for 1 hour and at 0.59 μm when immersed for 3 hours, and the gold coating thickness could be seen to increase linearly as time elapsed. As is clear from comparison with Comparative Example 1, which will be described later, the simultaneous addition of the very small amounts of copper compound and thallium ion increased the deposition rate by about 8 times compared with the plating solution to which they were not added. Furthermore, the plating solution did not show any formation of precipitate, any change in solution color, etc., and had excellent stability.

Example 4

Electroless plating was carried out by the same method and using a test piece of the same plating sample as in Example 1, but using a plating solution with 1 mg/L of lead ion (added as lead nitrate) added thereto instead of the copper cyanide and the potassium cyanide of the plating solution composition used in Example 1. As a result, bright golden semi-gloss gold was deposited at a thickness of 0.13 μm when immersed for 1 hour and at 0.34 μm when immersed for 3 hours, and the gold coating thickness could be seen to increase linearly as time elapsed. As is clear from comparison with Comparative Example 1, which will be described later, the addition of the very small amount of lead ion increased the deposition rate by about 5 times compared with the plating solution to which it was not added. Furthermore, the plating solution did not show any formation of precipitate, any change in solution color, etc., and had excellent stability.

Comparative Example 1

Electroless plating was carried out by the same method and using a test piece of the same plating sample as in Example 1, but using a plating solution obtained by adding no copper cyanide and no potassium cyanide when preparing the plating solution composition in Example 1. As a result, bright golden semi-gloss gold was deposited at a thickness of 0.03 μm when immersed for 1 hour and at 0.07 μm when immersed for 3 hours. Although the gold coating thickness could be seen to increase linearly as time elapsed, since the very small amounts of copper compound and thallium ion were not added, the gold deposition rate was very slow, and a practical speed could not be obtained.

Example 5

Electroless plating was carried out by immersing for a predetermined period of time a test piece of the above-mentioned plating sample in a plating solution having the solution composition shown below. As a result, bright golden semi-gloss gold was deposited at a thickness of 0.16 μm when immersed for 1 hour and at 0.54 μm when immersed for 3 hours, and the gold coating thickness could be seen to increase linearly as time elapsed. As is clear from comparison with Comparative Example 2, which will be described later, addition of a very small amount of a copper compound increased the deposition rate by about 10 times compared with a plating solution to which the copper compound was not added. Furthermore, the plating solution did not show any formation of precipitate, any change in solution color, etc., and had excellent stability.

| Plating solution composition | |
|---|---|
| Gold potassium cyanide | 0.02 mol/L |
| L-Ascorbic acid | 1.0 mol/L |
| Copper potassium cyanide | 10 mg/L(as copper) |
| Citric acid | appropriate amount for adjusting pH to 4.5 |

| Plating conditions | |
|---|---|
| Solution temperature | 80° C. |
| Solution pH | 4.5 |
| Stirring | stirred by stirrer |

Example 6

Electroless plating was carried out by immersing for a predetermined period of time a test piece of the above-mentioned plating sample in a solution prepared by increasing the copper potassium cyanide concentration of the plating solution composition used in Example 5 to 100 mg/L (as copper). As a result, bright golden semi-gloss gold was deposited at a thickness of 0.3 μm when immersed for 1 hour, at 0.93 μm when immersed for 3 hours, and at 1.7 μm when immersed for 5 hours, and the gold coating thickness could be seen to increase linearly as time elapsed. As is clear from comparison with Comparative Example 2, which will be described later, the addition of the small amount of copper compound increased the deposition rate by about 18 times compared with the plating solution to which the copper compound was not added. Furthermore, the plating solution did not show any formation of precipitate, any change in solution color, etc., and had excellent stability.

Example 7

Electroless plating was carried out by immersing for a predetermined period of time a test piece of the above-mentioned plating sample in a solution prepared by adding 1 mg/L of thallium ion (added as thallium nitrate) instead of the copper potassium cyanide of the plating solution composition used in Example 5. As a result, bright golden semi-gloss gold was deposited at a thickness of 0.07 μm when immersed for 1 hour and at 0.19 μm when immersed for 3 hours, and the gold coating thickness could be seen to increase linearly as time elapsed. As is clear from comparison with Comparative Example 2, which will be described later, the addition of the very small amount of thallium ion increased the deposition rate by about 4 times compared with the plating solution to which it was not added. Furthermore, the plating solution did not show any formation of precipitate, any change in solution color, etc., and had excellent stability.

Comparative Example 2

Electroless plating was carried out by the same method and using a test piece of the same plating sample as in Examples 5 and 6, but using a plating solution prepared by adding no copper potassium cyanide and no thallium ion when preparing the plating solution composition in Examples 5 and 6. As a result, bright golden semi-gloss gold was deposited at a thickness of 0.03 μm when immersed for 1 hour and at 0.05 μm when immersed for 3 hours. Although a slight amount of gold was deposited, there was a possibility that it might have been caused by a displacement reaction because of the pH conditions. In any event, under the conditions in which the very small amounts of copper compound and thallium ion were not added, the speed was very slow, or almost no gold was deposited.

Example 8

Electroless plating was carried out by immersing for a predetermined period of time a test piece of the above-mentioned plating sample in a plating solution having the solution composition shown below. As a result, bright golden semi-gloss gold was deposited at a thickness of 0.09 μm when immersed for 1 hour and at 0.27 μm when immersed for 3 hours, and the gold coating thickness could be seen to increase linearly as time elapsed. As is clear from comparison with Comparative Example 3, which will be described later, addition of very small amounts of copper compound and thallium ion increased the deposition rate by about 5 times compared with a plating solution to which they were not added. Furthermore, the plating solution did not show any formation of precipitate, any change in solution color, etc., and had excellent stability.

| Plating solution composition | |
|---|---|
| Gold potassium cyanide | 0.02 mol/L |
| Sodium L-ascorbate | 1.0 mol/L |
| Copper potassium cyanide | 10 mg/L(as copper) |
| Thallium ion (added as thallium sulfate) | 1 mg/L |
| Citric acid | appropriate amount for adjusting pH to 7 |

| Plating conditions | |
|---|---|
| Solution temperature | 60° C. |
| Solution pH | 7 |
| Stirring | stirred by stirrer |

Comparative Example 3

Electroless plating was carried out by the same method and using a test piece of the same plating sample as in Example 8, but using a plating solution prepared by adding no copper compound and no thallium ion when preparing the plating solution composition in Example 8. As a result, bright golden semi-gloss gold was deposited at a thickness of 0.02 μm when immersed for 1 hour and at 0.04 μm when immersed for 3 hours. Although a slight amount of gold was deposited, there was a possibility that it might have been caused by a displacement reaction because of the pH conditions. In any event, under the conditions in which the very small amounts of copper compound and thallium ion were not added, the speed was very slow, or almost no gold was deposited.

Example 9

Electroless plating was carried out by immersing for a predetermined period of time a test piece of the above-mentioned plating sample in a solution prepared by adjusting the pH of a plating solution having the same composition as that of Example 8 to 4.5 using citric acid. As a result, bright golden semi-gloss gold was deposited at a thickness of 0.07 μm when immersed for 1 hour and at 0.23 μm when immersed for 3 hours, and the gold coating thickness could be seen to increase linearly as time elapsed. As is clear from comparison with Comparative Example 4, which will be described later, the addition of the very small amounts of copper compound and thallium ion increased the deposition rate by about 5 times compared with a plating solution to which they were not added. Furthermore, the plating solution did not show any formation of precipitate, any change in solution color, etc., and had excellent stability.

Comparative Example 4

Electroless plating was carried out by the same method and using a test piece of the same plating sample as in Example 9, but using a plating solution prepared by adding no copper compound and no thallium ion when preparing the plating solution composition in Example 9. As a result, bright golden semi-gloss gold was deposited at a thickness of 0.02 μm when immersed for 1 hour and at 0.04 μm when immersed for 3 hours. Although a slight amount of gold was deposited, there was a possibility that it might have been caused by a displacement reaction because of the pH conditions. In any event, under the conditions in which the very small amounts of copper ion and thallium ion were not added, the speed was very slow, or almost no gold was deposited.

Example 10

Electroless plating was carried out by immersing for a predetermined period of time a test piece of the above-mentioned plating sample in a plating solution having the solution composition shown below. As a result, bright golden semi-gloss gold was deposited at a thickness of about 0.55 μm when immersed for 1 hour and at about 1.83 μm when immersed for 3 hours, and the gold coating thickness could be seen to increase linearly as time elapsed. As is clear from comparison with Comparative Example 5, which will be described later, addition of very small amounts of copper compound and complexing agent increased the deposition rate by about 27 times compared with a plating solution to which they were not added. Furthermore, the plating solution did not show any formation of precipitate, any change in solution color, etc., and had excellent stability.

| Plating solution composition | |
|---|---|
| Gold potassium cyanide | 0.03 mol/L |
| Sodium L-ascorbate | 1.0 mol/L |
| Copper (I) thiocyanate | 10 mg/L(as copper) |
| Potassium thiocyanate | 0.5 mmol/L |
| Citric acid | 0.02 mol/L |
| Sulfuric acid | appropriate amount for adjusting pH to 3.5 |

| Plating conditions | |
|---|---|
| Solution temperature | 80° C. |
| Solution pH | 3.5 |
| Stirring | stirred by stirrer |

Example 11

Electroless plating was carried out by immersing for a predetermined period of time a test piece of the above-mentioned plating sample in a solution prepared by adding 20 mmol/L of potassium cyanide instead of the potassium thiocyanate of the plating solution composition used in Example 10. As a result, bright golden semi-gloss gold was deposited at a thickness of about 0.44 μm when immersed for 1 hour and at about 1.50 μm when immersed for 3 hours, and the gold coating thickness could be seen to increase linearly as time elapsed. As is clear from comparison with Comparative Example 5, which will be described later, the addition of the very small amounts of copper compound and complexing agent increased the deposition rate by about 22 times compared with the plating solution to which they were not added. Furthermore, the plating solution did not show any formation of precipitate, any change in solution color, etc., and had excellent stability.

Comparative Example 5

Electroless plating was carried out by the same method and using a test piece of the same plating sample as in Examples 10 and 11, but using a plating solution prepared by adding no copper (I) thiocyanate, no potassium thiocyanate, and no potassium cyanide when preparing the plating solution composition in Examples 10 and 11. As a result, bright golden semi-gloss gold was deposited at a thickness of about 0.02 μm when immersed for 1 hour and at about 0.06 μm when immersed for 3 hours. Although a slight amount of gold was deposited, there was a possibility that it might have been caused by a displacement reaction because of the pH conditions. In any event, under the conditions in which the very small amounts of copper compound and complexing agent were not added, the speed was very slow, or almost no gold was deposited.

Example 12

Electroless plating was carried out by immersing for a predetermined period of time a test piece of the above-mentioned plating sample in a plating solution having the solution composition shown below. As a result, bright golden semi-gloss gold was deposited at a thickness of about 0.21 μm when immersed for 1 hour and at about 0.62 μm when immersed for 3 hours, and the gold coating thickness could be seen to increase linearly as time elapsed. As is clear from comparison with Comparative Example 6, which will be described later, addition of very small amounts of copper compound and complexing agent increased the deposition rate by about 7 times compared with the plating solution to which they were not added. Furthermore, the plating solution did not show any formation of precipitate, any change in solution color, etc., and had excellent stability.

| Plating solution composition | |
|---|---|
| Gold potassium cyanide | 0.03 mol/L |
| Sodium L-ascorbate | 1.0 mol/L |
| Disodium copper ethylenediaminetetraacetate tetrahydrate | 10 mg/L(as copper) |
| Dihydrogen disodium ethylenediaminetetraacetate dihydrate | 1.6 mmol/L |
| Citric acid | 0.02 mol/L |
| Acetic acid | appropriate amount for adjusting pH to 5.5 |

| Plating conditions | |
|---|---|
| Solution temperature | 80° C. |
| Solution pH | 5.5 |
| Stirring | stirred by stirrer |

Comparative Example 6

Electroless plating was carried out by the same method and using a test piece of the same plating sample as in Example 12, but using a plating solution prepared by adding no disodium copper ethylenediaminetetraacetate tetrahydrate and no dihydrogen disodium ethylenediaminetetraacetate dihydrate when preparing the plating solution composition in Example 12. As a result, bright golden semi-gloss gold was deposited at a thickness of about 0.03 μm when immersed for 1 hour and at about 0.08 μm when immersed for 3 hours. Although a slight amount of gold was deposited, there was a possibility that it might have been caused by a displacement reaction because of the pH conditions. In any event, under the conditions in which the very small amounts of copper compound and complexing agent were not added, the speed was very slow, or almost no gold was deposited.

INDUSTRIAL APPLICABILITY

Since the present invention enables thick plating of a gold coating to be carried out by an autocatalytic reaction under acidic to neutral conditions, it finds application in the semiconductor field with materials that are susceptible to alkali such as polyimide or aluminum nitride, or to a semiconductor material equipped with a positive photoresist, and contributes greatly to the development of related industries.

What is claimed is:

1. An electroless gold plating solution comprising a cyanide compound, ascorbic acid or a derivative thereof, and a copper compound.

2. The electroless gold plating solution according to claim 1, wherein it further comprises a complexing agent.

3. The electroless gold plating solution according to claim 1, wherein it further comprises a thallium compound and/or a lead compound.

4. The electroless gold plating solution according to claim 1, wherein the solution has a pH of 3 to 7.5.

5. The electroless gold plating solution according to claim 1, wherein the copper compound is copper potassium cyanide, copper thiocyanate, or disodium copper ethylenediaminetetraacetate tetrahydrate.

6. The electroless gold plating solution according to claim 2, wherein the complexing agent is a cyanide compound, a thiocyanate compound, or a polycarboxylic acid.

7. The electroless gold plating solution according to claim 3, wherein the thallium compound is thallium sulfate or thallium nitrate.

8. The electroless gold plating solution according to claim 3, wherein the lead compound is lead nitrate or lead acetate.

* * * * *